United States Patent [19]

Rissanen

[11] Patent Number: 5,005,542

[45] Date of Patent: Apr. 9, 1991

[54] ENGINE PREHEATING DEVICE

[76] Inventor: David Rissanen, Box 175, Big Falls, Minn. 56627

[21] Appl. No.: 459,465

[22] Filed: Jan. 2, 1990

[51] Int. Cl.[5] ..... F02N 17/02

[52] U.S. Cl. ..... 123/142.5 R; 122/20 B

[58] Field of Search ..... 123/142.5 RG; 122/20 B; 237/12.3 B, 12.3 C

[56] References Cited

U.S. PATENT DOCUMENTS

| | | | |
|---|---|---|---|
| 2,021,569 | 11/1935 | Pasco | 237/12.3 C |
| 4,010,725 | 3/1977 | White | 123/145.2 R |
| 4,105,158 | 8/1978 | Hasebe et al. | 237/12.3 C |
| 4,317,434 | 3/1982 | Kato | 123/179 BG |
| 4,348,992 | 9/1982 | Southard | 123/142.5 R |
| 4,392,609 | 7/1983 | Conterio | 237/12.3 C |
| 4,398,081 | 8/1983 | Moad | 123/142.5 E |
| 4,445,469 | 5/1984 | Suhayda | 123/142.2 R |
| 4,520,769 | 6/1985 | Kratzer | 237/12.3 C |
| 4,887,586 | 12/1989 | Walters | 122/20 B |

*Primary Examiner*—E. Rollins Cross

*Attorney, Agent, or Firm*—Jerry T. Kearns

[57] ABSTRACT

An engine preheating device for heating internal combustion engines prior to operation utilizes a propane torch and conventional propane supply tank. A hollow cylindrical housing is supported in upright orientation by a plurality of circumferentially spaced support legs. A helical heat exchanger coil is disposed in coaxial relation within the housing. An inlet conduit is coupled to a bottom end of the coil and an outlet conduit is coupled to an upper end of the coil. Quick connect couplings secure the inlet and outlet conduits to a water jacket of an internal combustion engine. An arcuate tubular elbow has a first end mounted in coaxial relation within the bottom end of the housing. A propane torch head is inserted within the elbow and is connected by a conduit to a propane supply tank. A flame diffuser is suspended within the coil by a tube connected to a top cover. In use, anti-freeze from the engine water jacket is heated within the coil by the propane torch head and caused to flow in a thermal cycle through the engine block.

8 Claims, 3 Drawing Sheets

ENGINE PREHEATING DEVICE

BACKGROUND OF THE INVENTION

1. Field of the Invention

The present invention relates to engine preheating devices, and more particularly pertains to an engine preheating device adapted for use in heating diesel engines in heavy construction and logging equipment. Diesel engines in various trucks and heavy equipment vehicles must be frequently operated in very low temperatures in cold climate regions. In order to start these engines, they must be first heated substantially above ambient temperature. In order to achieve this objective, the present invention provides a propane powered engine heating device adapted to utilize a conventional propane torch head and supply tank.

2. Description of the Prior Art

Various types of engine preheating devices are known in the prior art. A typical example of such an engine preheating device is to be found in C. White U.S. Pat. No. 4,010,725, issued on Mar. 8, 1977. This patent discloses a selfcontained device for preheating an internal combustion which utilizes an infra-red burner positioned in heat exchanging relationship with an engine. The device includes an ignition source for lighting a burner actuated by the battery of the engine. Y. Kato U.S. Pat. No. 4,317,434, issued on Mar. 2, 1982, discloses a preheating device for diesel engines which utilizes a parallel circuit of a resistor exhibiting an ordinary resistance characteristic and a starting resistor abruptly increasing its resistance at a certain temperature. The resistance circuit is inserted between glow plugs in a diesel engine and a battery. E. Southard U.S. Pat. No. 4,348,992, issued on Sept. 14, 1982, discloses an engine block heater for heating the coolant in a liquid cooled internal combustion engine which includes concentrically arranged inner and outer casings defining a water chamber which communicates with the water in the engine block. A propane gas burner is utilized to heat the cooled liquid. M. Moad U.S. Pat. No. 4,398,081, issued on Aug. 9, 1983, discloses an auxiliary heating and power supply system for a motor vehicle which utilizes an electric heater and pump connected in the conventional heater coolant line adjacent the upstream side of the rear heat exchanger unit. L. Suhayda U.S. Pat. No. 4,445,469, issued on May 1, 1984, discloses an engine heater for use in vehicles which utilizes propane gas to heat the engine. The heater employs electrical power to control the combustion of the propane gas and to propel heated combustion products toward the engine.

While the above mentioned devices are directed to engine preheaters, none of these devices is usable with a conventional propane torch and supply tank. Additionally, none of these devices allows for a remote mounting from a vehicle to minimize fire hazards. Inasmuch as the art is relatively crowded with respect to these various types of engine preheating devices, it can be appreciated that there is a continuing need for and interest in improvements to such engine preheating devices, and in this respect, the present invention addresses this need and interest.

SUMMARY OF THE INVENTION

In view of the foregoing disadvantages inherent in the known types of engine preheating devices now present in the prior art, the present invention provides an improved engine preheating device. As such, the general purpose of the present invention, which will be described subsequentlY in greater detail, is to provide a new and improved engine preheating device which has all the advantages of the prior art engine preheating devices and none of the disadvantages.

To attain this, a representative embodiment of the concepts of the present invention is illustrated in the drawings and makes use of an engine preheating device for heating internal combustion engines prior to operation which utilizes a propane torch and conventional propane supply tank. A hollow cylindrical housing is supported in upright orientation by a plurality of circumferentially spaced support legs. A helical heat exchanger coil is disposed in coaxial relation within the housing. An inlet conduit is coupled to a bottom end of the coil and an outlet conduit is coupled to an upper end of the coil. Quick connect couplings secure the inlet and outlet conduits to a water jacket of an internal combustion engine. An arcuate tubular elbow has a first end mounted in coaxial relation within the bottom end of the housing. A propane torch head is inserted within the elbow and is connected by a conduit to a propane supply tank. A flame diffuser is suspended within the coil by a tube connected to a top cover. In use, anti-freeze from the engine water jacket is heated within the coil by the propane torch head and caused to flow in a thermal cycle through the engine block.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved engine preheating device which has all the advantages of the prior art engine preheating devices and none of the disadvantages.

It is another object of the present invention to provide a new and improved engine preheating device which may be easily and efficiently manufactured and marketed.

It is a further object of the present invention to provide a new and improved engine preheating device which is of a durable and reliable construction.

An even further object of the present inventiOn is to provide a new and improved engine preheating device which is susceptible of a low cost of manufacture with regard to both materials and labor, and which accordingly is then susceptible of low prices of sale to the consuming public, thereby making such engine preheating devices economically available to the buying public.

Still yet another object of the present invention is to provide a new and improved engine preheating device which provides in the apparatuses and methods of the prior art some of the advantages thereof, while simultaneously overcoming some of the disadvantages normally associated therewith.

Still another object of the present invention is to provide a new and improved engine preheating device for heating liquid cooled internal combustion engines prior to operation in low temperature environment.

Yet another object of the present invention is to provide a new and improved engine preheating device which utilizes a conventional propane torch and supply tank.

Even still another object of the present invention is to provide a new and improved engine preheating device which is remotely located from a vehicle to minimize fire hazards.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
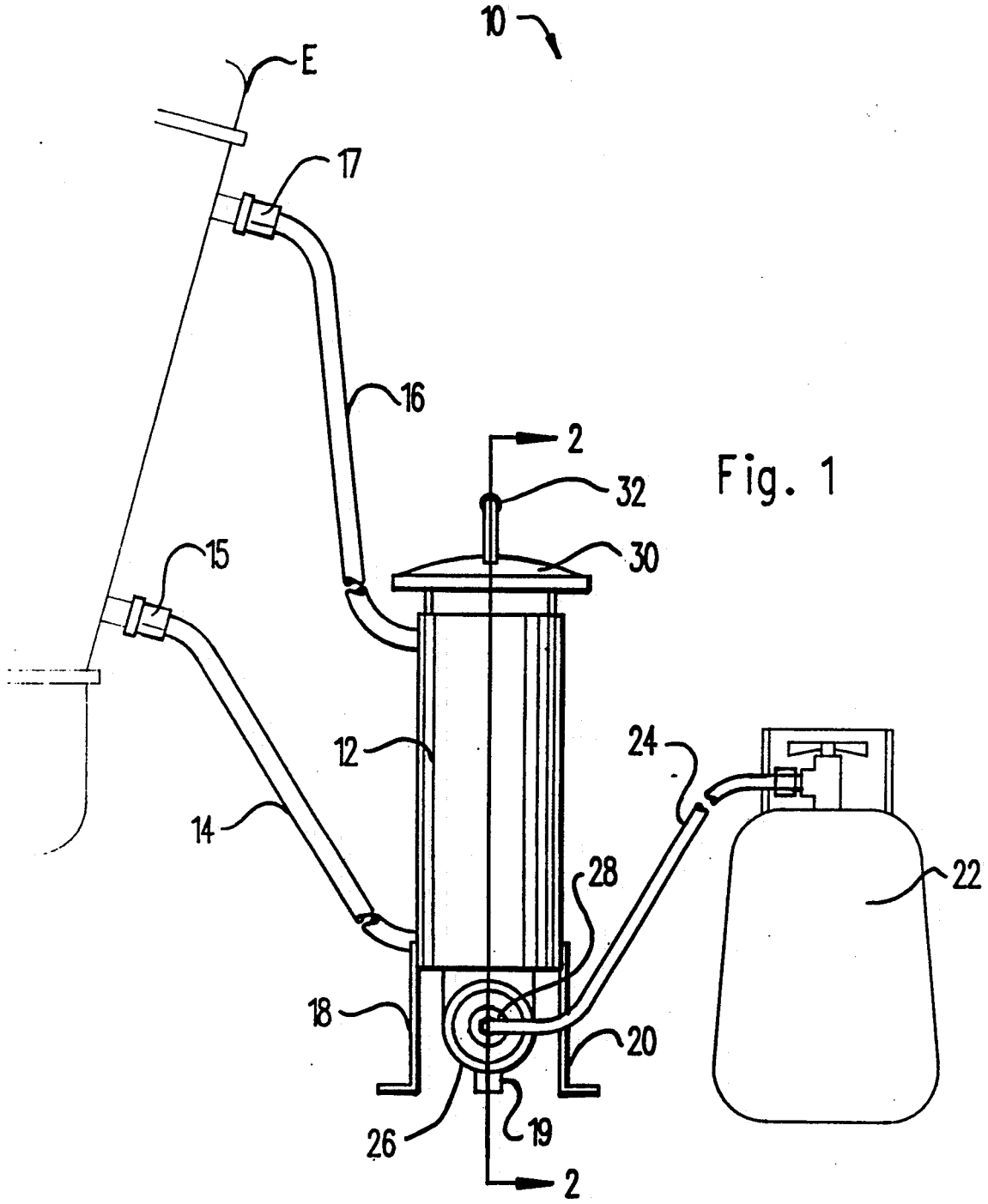
FIG. 1 is a side view illustrating the engine preheating device of the present invention.

With reference now to the drawings, and in particular to FIG. 1 thereof, a new and improved engine preheating device embodying the principles and concepts of the present invention and generally designated by the reference numeral 10 will be described.

More specifically, it will be noted that the first embodiment 10 of the invention includes a hollow cylindrical housing 12 extending in a vertical upright position. A plurality of support legs 18, 19 and 20 are spaced circumferentially around a bottom end of the housing 12. An inlet conduit 14 is formed by a conventional heater hose material and includes a quick release coupling 15 for securement in fluid communication to the water jacket of an internal combustion engine E. A similarly formed outlet conduit 16 is secured by a quick release coupling 17 to form a closed fluid cycle. A cover 30 is mounted in vertically spaced relation above an upper end of the housing 12 and includes an insulated handle 32 to enable convenient transportation of the preheating device 10. An elbow 26 is mounted adjacent a bottom end of the housing 12 and is dimensioned for insertion of a conventional propane torch head 28. The torch head 28 is connected by a conduit 24 to a conventional propane supply tank 22.

Figure 2:
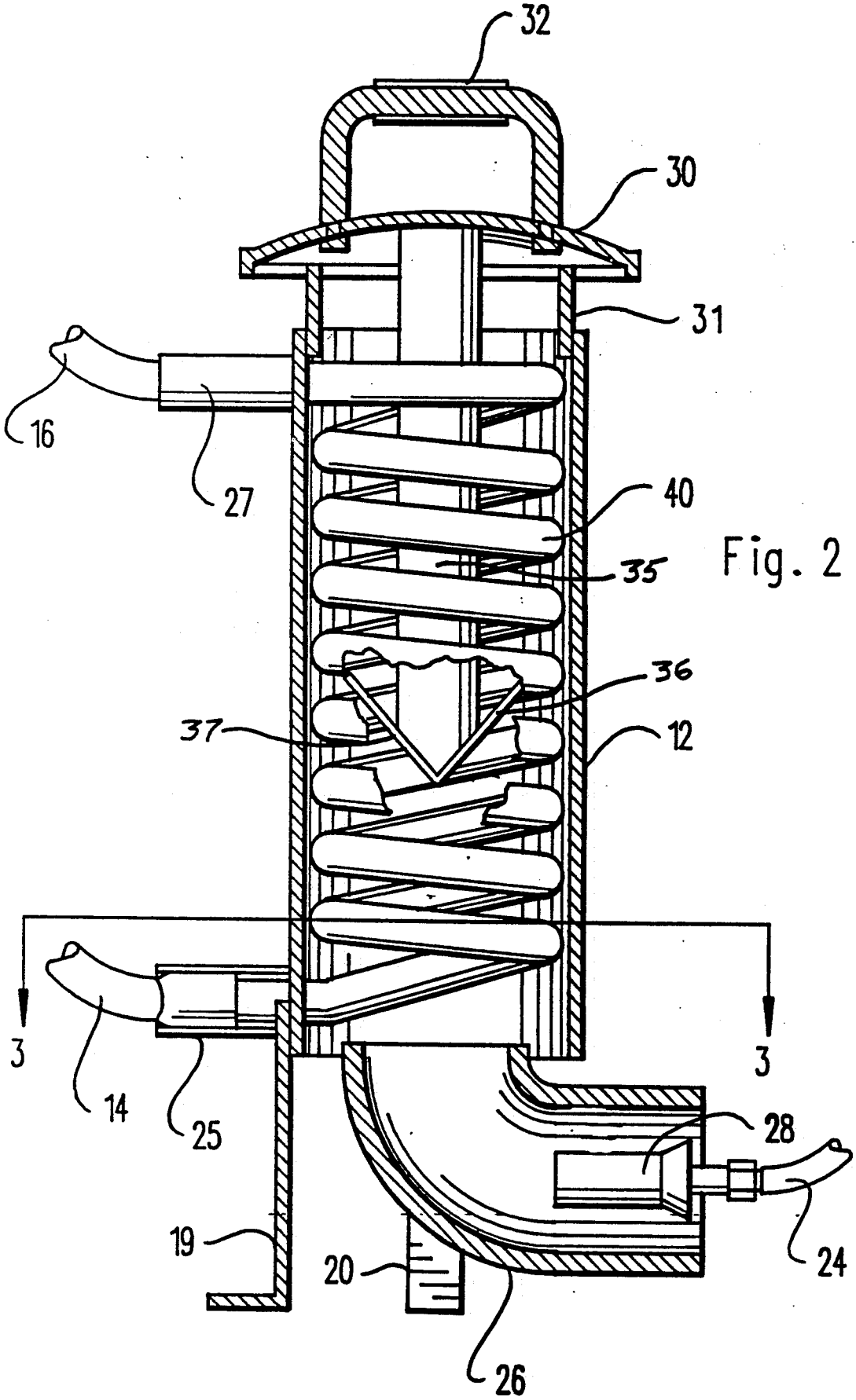
FIG. 2 is a cross sectional view, taken along line 2—2 of FIG. 1.

As shown in FIG. 2, a helical heat exchange tubular coil 40 is disposed in coaxial relation within the interior of the housing 12. In use, anti-freeze flows through the inlet conduit 14 to the bottom end of the coil 40, where it is heated by the torch head 28. The heated coolant then travels upwardly in a thermal cycle through the coil 40 and through the outlet conduit 16 back to the engine water jacket. The thermal cycle eliminates the need for any pumping system and allows for an inexpensive and maintenance free construction. A cYlindrical tube 35 is suspended within the coil 40, and supports a flame diffuser. The flame diffuser includes two semi-circular baffles 36 and 37 connected to form a V configuration at an acute angle, as shown. A clearance space of about one inch is provided between the flame diffuser baffles 36 and 37 and the coil 40, to allow escape of exhaust gases from the torch head. This is especially important at sub-zero temperatures, in which obstructions close to the torch head will cause the flame to blow out. The inlet 14 and outlet conduits 16 are connected by couplings 25 and 27 to the heat exchange coil 40. The cover 30 is mounted by a plurality of circumferentially spaced vertical tabs 31, above the upper end of the housing 12. This forms a combustion gas outlet between the tabs 31 and the cover 30.

Figure 3:
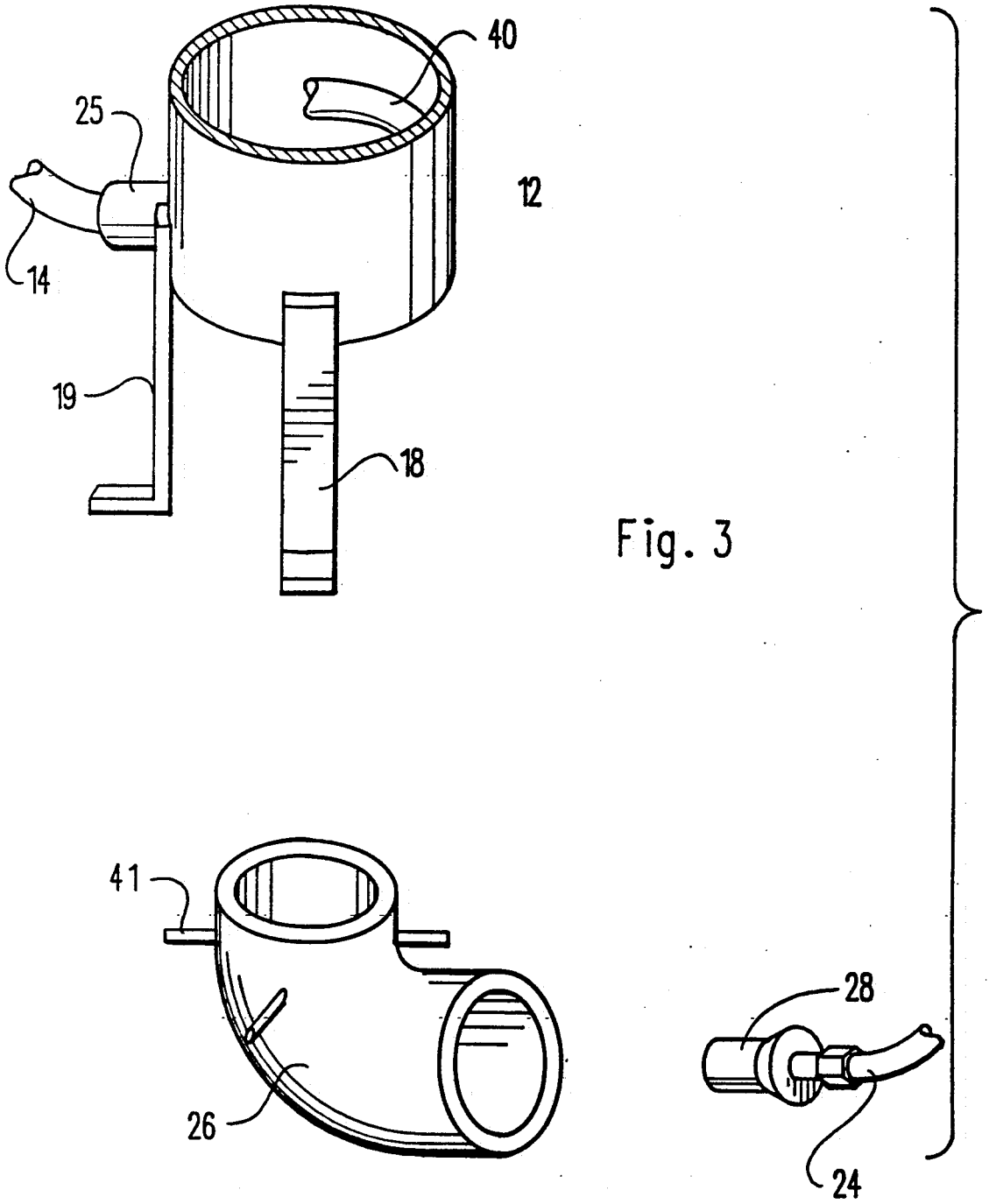
FIG. 3 is a cross sectional view, taken along line 3—3 of FIG. 2, and shown in exploded perspective to illustrate the constructional details of the various components.

FIG. 3 illustrates a partial exploded view, further illustrating the construction of the various previously described components. The vertical portion of the elbow 26 includes a plurality of radial fingers 41 adapted for securement within the bottom end of the cylindrical housing 12. In tests, the engine preheating device of the present invention has been found to heat a large diesel engine block full of anti-freeze at −30 degrees F. to 160 degrees F. in 20 minutes. A single preheating device may be utilized to heat engines of a plurality of vehicles, by employing quick release couplings on each engine block. The use of the preheating device of the present invention obviates the need to utilize starting fluids such as ether which results in premature engine wear due to operation of engines at high RPM width cold viscous oil. By employing inlet and outlet connecting conduits of about 10 feet in length, the device may be remotely situated to eliminate any fire hazard. This is an important requirement because insurance companies refuse to provide insurance for vehicles equipped with in situ mounted gas fired engine preheating devices.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An engine preheating device, comprising:
a hollow cylindrical housing;
a plurality of support legs spaced circumferentially around a bottom end of said housing for supporting said housing in an upright orientation;
a helical heat exchange coil in said housing;
an inlet conduit coupled to a bottom end of said coil, said inlet conduit having a quick connect coupling for fluid connection to an internal combustion engine water jacket;
an outlet conduit coupled to an upper end of said coil, said outlet conduit having a quick connect coupling for fluid connection to an internal combustion engine water jacket;
an arcuate tubular elbow having a first end secured in coaxial relation within said bottom end of said housing and a second open end;
a propane torch head inserted within a second open end of said elbow;
a conduit connecting said torch head to a propane supply tank;
a cover mounted in vertically spaced relation on an upper end of said housing bY a plurality of circumferentially spaced vertical tabs, a combustion gas outlet formed between said tabs and said cover;
a tube having a first end connected to said cover, said tube extending centrally and axially within said coil;
a flame diffuser secured to a second end of said tube, said flame diffuser having two semi-circular baffles connected at an acute angle; and
an insulated handle on an upper exterior surface of said cover.

2. An engine preheating device, comprising:
an open ended hollow cylindrical housing;
a heat exchanger coil in said housing;
base means for supporting said housing;
torch support means including a tubular elbow having a first end secured in coaxial relation within a bottom end of said housing for supporting a propane torch head adjacent said coil;
supply means for supplying propane to said torch head; and
inlet and outlet conduit means for connecting said coil in fluid communication with a water jacket of an internal combustion engine.

3. The engine preheating device of claim 2, wherein said torch support means comprises an opening in said elbow dimensioned for insertion of a variety of different standard sized torch heads.

4. The engine preheating device of claim 2, wherein said coil is a helical tubular coil disposed coaxially within said housing.

5. An engine preheating device, comprising:
a housing;
a heat exchanger coil in said housing;
base means for supporting said housing;
a cover mounted in vertically spaced relation on an upper end of said housing by a plurality of circumferentially spaced vertical tabs, a combustion gas outlet formed between said tabs and said cover;
an insulated handle on an upper exterior surface of said cover;
torch support means for supporting a propane torch head adjacent said coil;
supply means for supplying propane to said torch head; and
inlet and outlet conduit means for connecting said coil in fluid communication with a water jacket of an internal combustion engine.

6. The engine preheating device of claim 5, further comprising a tube extending within said coil, said tube having a first end connected to said cover and a second end secured to a flame diffuser, said flame diffuser having two semi-circular baffles connected at an acute angle.

7. The engine preheating device of claim 5, wherein said housing comprises a hollow open ended cylinder.

8. The engine preheating device of claim 7, wherein said coil is a helical tubular coil disposed coaxially within said housing.

* * * * *